United States Patent [19]

Tanner

[11] Patent Number: 4,765,099

[45] Date of Patent: Aug. 23, 1988

[54] SANDING AND DUST COLLECTING APPARATUS

[76] Inventor: John G. Tanner, 12605 Hickory Hollow Dr., Oklahoma City, Okla. 73142

[21] Appl. No.: 940,594

[22] Filed: Dec. 11, 1986

[51] Int. Cl.[4] ..... B24B 23/02

[52] U.S. Cl. ..... 51/170 T; 51/273

[58] Field of Search ..... 51/170 R, 170 T, 273

[56] References Cited

FOREIGN PATENT DOCUMENTS

| | | | |
|---|---|---|---|
| 1189405 | 3/1965 | Fed. Rep. of Germany | 51/170 T |
| 2542183 | 4/1976 | Fed. Rep. of Germany | 51/170 T |
| 3120871 | 12/1982 | Fed. Rep. of Germany | 51/170 T |
| 428280 | 12/1947 | Italy | 51/170 T |
| 747700 | 7/1980 | U.S.S.R. | 51/270 |

*Primary Examiner*—Roscoe V. Parker

*Attorney, Agent, or Firm*—Bill D. McCarthy

[57] ABSTRACT

An improved sanding and dust collecting apparatus connectable to a pneumatic powered actuator is provided which permits one to control and collect the dust and particulate residue generated during the sanding of a surface without the use of external vacuum equipment. The apparatus comprises a housing assembly attachable to and supported by the actuator assembly, an impeller blade assembly rotatably supported within the housing assembly for creating a vortex-like suction within the housing assembly when rotated by a driver spindle of the actuator, a spindle member connected to the driver spindle for rotation thereby, and a sanding disc assembly connected to and supported by the spindle for producing a sanding motion on a surface in response to actuation of the power actuator assembly. A brush assembly is supported by a lower end portion of the housing assembly for forming a flexible dust containment curtain about the sanding disc assembly so that dust and particulate matter generated by the sanding disc assembly is confined within the brush assembly for delivery upwardly through the housing assembly. An outlet port is provided in a side wall of the housing assembly, and a collector member having an internal bore extensive therethrough is connected the housing assembly such that communication is established between a blower cavity of the housing assembly, the outlet port and the collector member. The dust and particulate matter passing upwardly through blower cavity of the housing are discharged therefrom via the outlet port and the internal bore of the collector member into a collector bag assembly. The apparatus can further comprise a vortex blade assembly supported by the sanding disc assembly to assist in the passage of dust and particulate matter upwardly through the blower cavity.

39 Claims, 3 Drawing Sheets

SANDING AND DUST COLLECTING APPARATUS

BACKGROUND OF THE INVENTION

1. Field of the Invention

The present invention relates generally to sanding apparatus, and more particularly, but not by way of limitation, to a hand held sanding and dust collecting apparatus for use in combination with a powered actuator assembly having a rotatable driver spindle.

2. Brief Description of the Prior Art

Power actuated sanding apparatuses have heretofore been known and used in sanding or grinding operations to provide a substantially smooth surface to a material, or for removing paint and finishes from such material. While such apparatuses have generally been accepted, problems have nevertheless been encountered in the collection and control of the dust and other particulate materials generated during the sanding or grinding operation.

Control and containment of dust and particulate materials generated during a sanding operation are often desirable for personal safety of the user of the sanding apparatus because of the potentially hazardous and toxic nature of certain residues which may be generated, especially when glass reinforced plastics, graphite reinforced plastics, certain paints and other such finishes are removed from metals and various other substrates. In addition, when sanding a wooden surface it is desirable to contain the dust and particulate matter to prevent same from being dispersed throughout the room and thus creating a dust filled atmosphere to which the worker is exposed.

Numerous devices have heretofore been made for controlling and containing the dust residue and particulate matter generated during a sanding operation. In many instances the attachment of a collecting device to the sanding apparatus is ineffective and collects only a portion of the dust and particulate matter. Other times, bulky auxiliary vacuuming equipment is employed which renders the sanding apparatus difficult and cumbersome to handle. Even then, such auxiliary vacuuming equipment is ineffective in the collection of dust and particulate matter.

Other attempts to control dust and particulate matter generated during sanding have included the use of large vent hoods, down draft tables, and vacuum trailers attached to the sanders, or employed as separate units. The use of such equipment is generally effective in the collection of the dust and particulate matter, but the equipment is bulky, requires large amounts of floor space, is expensive, and results in inconvenience to the operator. In addition, the use of auxiliary equipment often requires additional personnel to operate the device, which is uneconomical and thus undesirable.

Therefore, it would be highly desirable if one could provide an improved sanding and dust collecting apparatus which utilizes the motion of the sanding disc to control and convey dust and particulate matter to a dust collecting portion of the apparatus, which is economical to manufacture, durable in construction, easy to use, readily controlled, and which collects substantially all of the dust and particulate matter removed. It is to such an apparatus that the subject invention is directed.

SUMMARY OF THE INVENTION

According to the present invention an improved sanding and dust collecting apparatus is provided which permits one to control and collect the dust and particulate residue generated during the sanding of a surface without the use of external vacuum equipment. The apparatus is connected to a powered actuator assembly having a rotatable driver spindle. Broadly, the apparatus comprises a housing assembly attachable to and supported by the actuator assembly, an impeller blade assembly rotatably supported within the housing assembly for creating a vortex-like suction within the housing assembly when rotated by the driver spindle, a spindle member connected to the driver spindle for rotation thereby, and a sanding disc assembly connected to and supportable by the spindle for producing a sanding motion on a surface in response to actuation of the power actuator assembly. A brush assembly is supported by a lower end portion of the housing assembly for forming a flexible dust containment curtain about the sanding disc assembly so that dust and particulate matter generated by the sanding effect of the sanding disc assembly on a surface is confined within the brush assembly for delivery upwardly through the housing assembly.

The housing assembly is further characterized as having an outlet port in a side wall thereof, and a collector member having an internal bore extensive therethrough is connected the housing assembly such that fluid communication is established between a blower cavity defined by the housing assembly, the outlet port and the collector member. The dust and particulate matter generated by the sanding disc assembly are lifted upwardly through the blower cavity of the housing and discharged therefrom via the outlet port and the internal bore of the collector member into a collector bag assembly.

Thus, the sanding and dust collecting apparatus of the present invention is self-contained, is easily useable by one person, and utilizes the motion of the sanding disc assembly to control and collect the dust and particulate matter in the collector bag by confinement of the dust and particulate matter within the brush assembly and by the upward movement of same through the blower cavity of the housing assembly for exhaust therefrom through the outlet port and the collector member.

An object of the present invention is to provide an improved sanding and dust collecting apparatus which effectively controls and collects dust and particulate matter removed from a surface being sanded.

Another object of the present invention, while achieving the before-stated object, is to provide an improved sanding and dust collecting apparatus which does not require the use of external equipment to control and collect the dust and particulate matter generated during the sanding of a surface.

Another object of the present invention, while achieving the before-stated objects, is to provide an improved sanding and dust collecting apparatus which is self-contained and readily useable by one person.

Another object of the present invention, while achieving the before-stated objects, is to provide an improved sanding and dust collecting apparatus which is compact, economical to manufacture, durable in construction, versatile, and which overcomes the deficiencies of the prior art devices.

Other objects, advantages and features of the present invention will become clear from the following detailed description when read in conjunction with drawings and the appended claims.

DESCRIPTION

The term "sanding" as used herein in the conditioning of a surface is to be understood to be equivalent with the term "grinding". That is, when a wood surface is conditioned it is commonly referred to as "sanding"; whereas when a metal surface is conditioned it is commonly referred to as "grinding".

In the following description of the inventive concept, like numerals will be used in the Figures to designate like components or assemblies.

Figure 1:
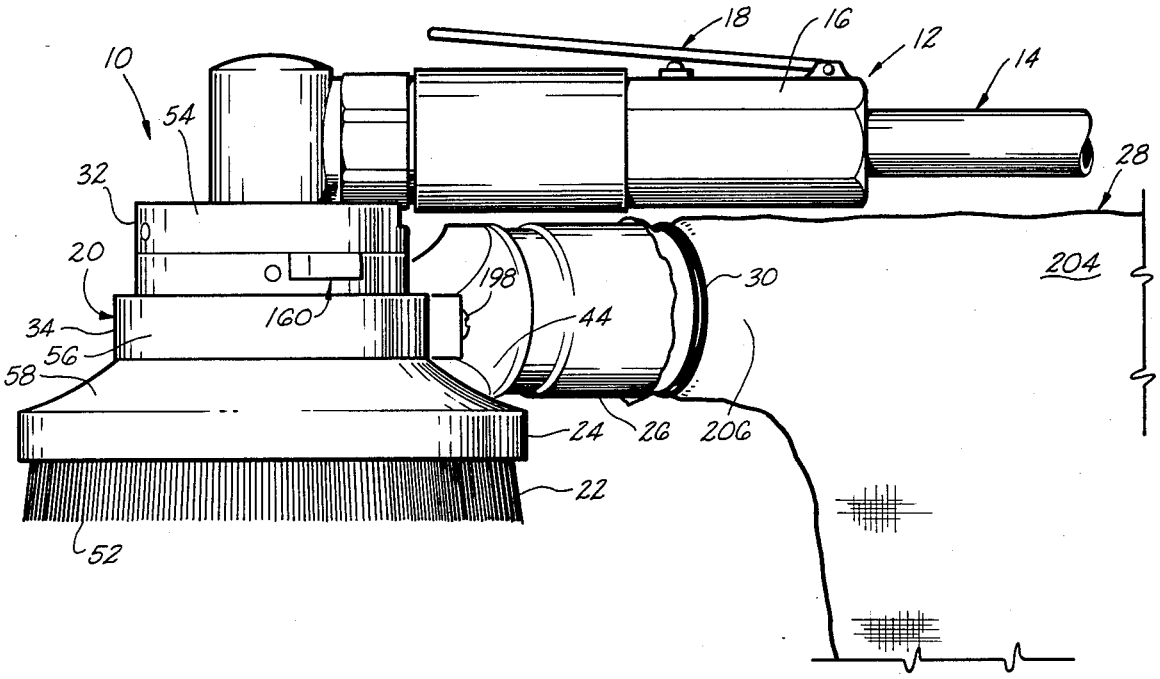
FIG. 1 is a side elevational, fragmentary view of a sanding and dust collecting apparatus of the present invention.

Referring to the drawings, and more particularly to FIG. 1, shown therein is a sanding and dust collecting apparatus 10 constructed in accordance with the present invention. The apparatus 10 is attachable to and supportable by a pneumatic powered actuator assembly 12 connected to a source of pressurized air (not shown) by a pneumatic hose 14. The actuator assembly 12 can be any suitable commercially available actuator having a hand-held body portion 16 and a hand-activated trigger mechanism 18 for selectively activating the actuator assembly 12 between an on mode and an off mode. When the actuator assembly 12 is in the on mode rotational motion is imparted to sanding and dust lifting components of the apparatus 10; whereas, when the actuator assembly 12 is in the off mode the sanding and dust lifting components of the apparatus 10 can be readily assembled or disassembled. A commercially available pneumatic actuator which can be used in combination with the apparatus 10 is a Dotco pneumatic driver, Model 10L 1280 22 available from Dotco Corporation of Hicksville, Ohio.

The apparatus 10 comprises a housing assembly 20, a brush 22 supported on a lower end portion 24 of the housing assembly 20 for forming a flexible dust containment curtain, a collector member 26 supported by the housing assembly 20, and a bag collector 28. The bag collector 28 is positionable on the collector member 26 and secured thereto by an O-ring 30 to insure that a substantially dust-tight connection is formed between the collector member 26 and the bag collector 28. As will be more fully described hereinafter, the interconnection and construction of the housing assembly 20, the brush 22, the collector member 26 and the bag collector 28 provide for the collection and containment of dust and particulate matter removed from a surface by the sanding components of the apparatus 10 so that the operation of the apparatus 10 substantially eliminates dust from being dispersed into a room or the atmosphere. That is, the construction of the apparatus 10 permits one to achieve a substantial dust-free environment when conditioning a surface.

Figure 2:
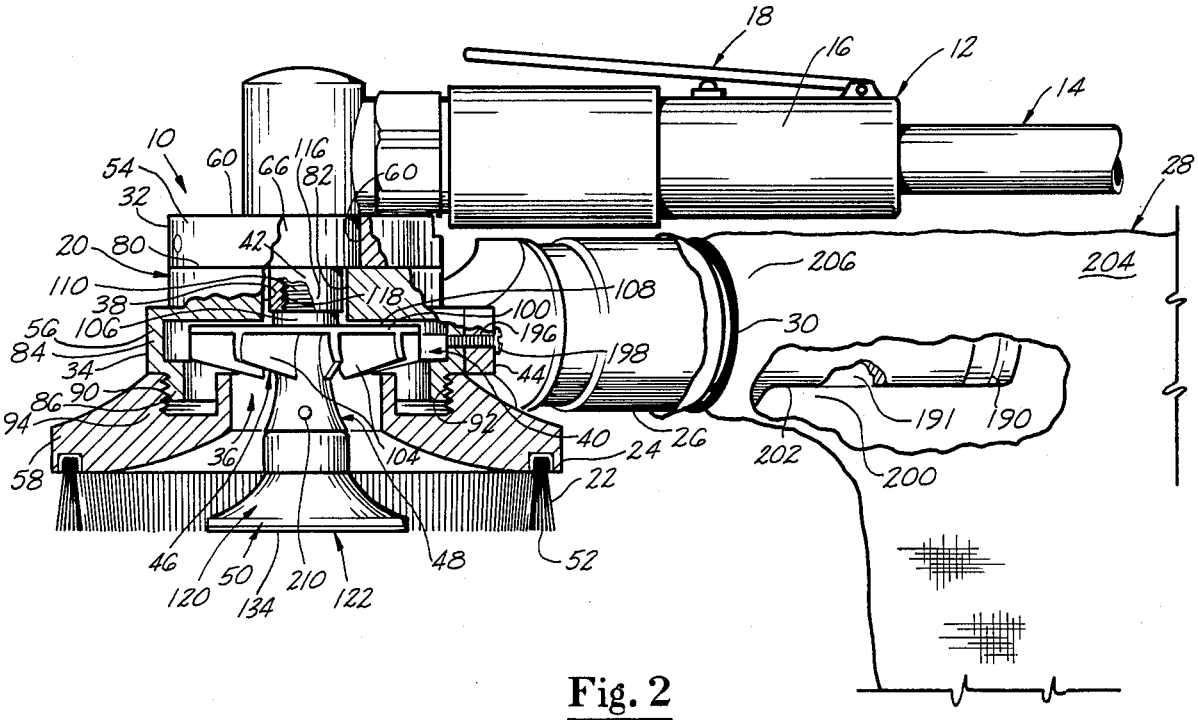
FIG. 2 is a side elevational, fragmentary, partially cutaway view of the sanding and dust collecting apparatus of FIG. 1.

Referring more specifically to FIG. 2, the housing assembly 20 of the apparatus 10 is further characterized as having an upper end portion 32 and a side wall 34. The upper end portion 32 and the side wall 34 cooperate to define a blower cavity 36. An axially disposed bore 38 extends through the upper end portion 32 and communicates with the blower cavity 36; and an outlet port 40 is disposed in the side wall 34 so as to communicate with the blower cavity 36. The bore 38 is adapted to receive a driver spindle 42 of the actuator assembly 12 so that apparatus 10 can be attached to and supported by the actuator assembly 12.

The collector member 26 is connected to the side wall 34 of the housing assembly 22 so that one end portion 44 of the collector member 26 is disposed over the outlet port 40. Thus, dust and particulate matter removed from a surface by the operation of the apparatus 10 is contained by the brush 22 and then vacuumed or directed upwardly through the blower cavity 36 and exhausted therefrom for deposit and collection in the collector bag 28 via the outlet port 40 and the collector member 26.

In order to effectively sand a surface and direct the dust and particulate materials removed by the sanding operation upwardly through the blower cavity 36 for discharge and collection in the bag collector 28, the apparatus 10 further comprises an impeller blade assembly 46, a spindle member 48 and sanding disc assembly 50. The impeller blade assembly 46 is rotatably supported by the driver spindle 42 of the actuator assembly 12 so as to be substantially adjacent and alignable with the outlet port 40 of the housing assembly 20. Thus, upon activation of the actuator assembly 12 to its on mode by suppression of the trigger mechanism 18, the impeller blade assembly 46 is rotated by the driver spindle 42. The rotation of the impeller blade assembly 46 creates a vortex-like suction or vacuum within the blower cavity 36 for directing airborne particulate material upwardly through the blower cavity 36 for discharge therefrom through the outlet port 40.

The spindle member 48 is connected to the driver spindle 42 of the actuator assembly 12 and extends between and connects the impeller blade assembly 46 to the sanding disc assembly 50. The spindle member 48 also functions as an extender member for the sanding disc assembly 50 to insure that the sanding disc assembly 50 is positionable substantially adjacent a distal end 52 of the brush 22 for engaging contact with the surface to be sanded.

Figure 4:
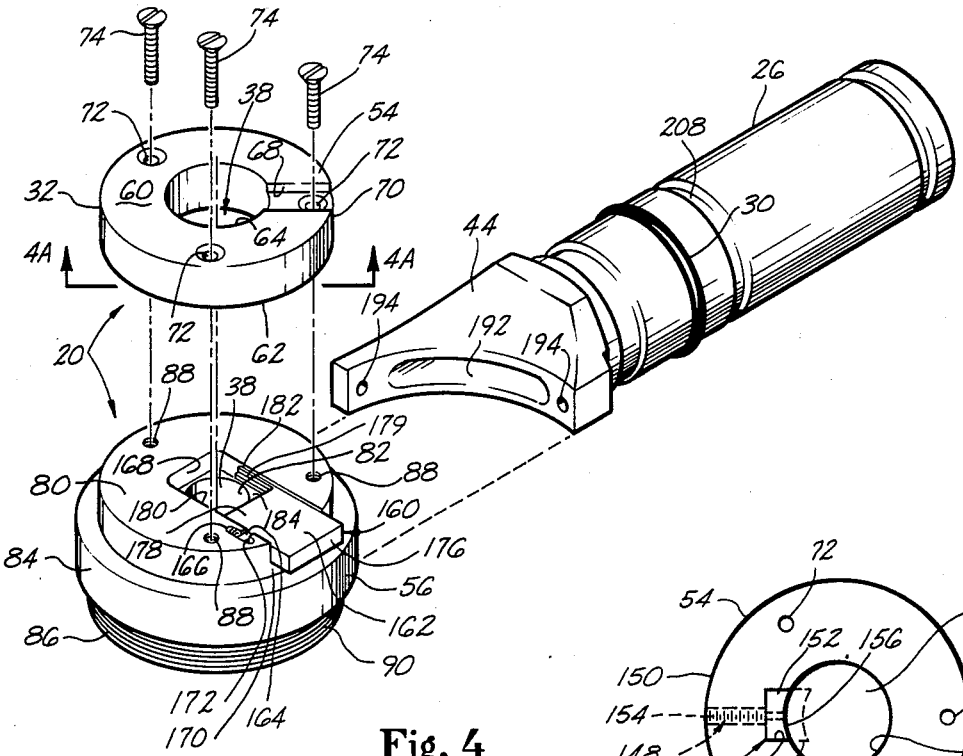
FIG. 4 is an exploded view of an upper portion of a housing assembly and a collector member of the sanding and dust collecting apparatus of the present invention.
Figure 5:
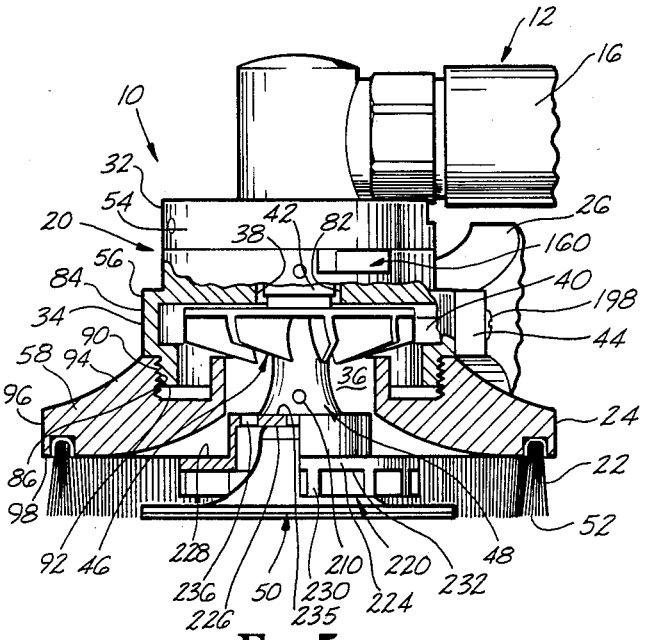
FIG. 5 is a partially broken, partially cutaway side elevational view of the sanding and dusting collecting apparatus of the present invention having a vortex impeller assembly.

Referring more specifically to FIGS. 2, 4 and 5, the housing assembly 20 includes an upper plate member 54, an impeller blade housing portion 56, and a brush housing portion 58. The upper plate member 54 is characterized as having a substantially planar upper side 60, a substantially planar lower side 62, and an axially disposed bore 64 extending therethrough. The bore 64 of the plate member 54 defines an upper portion of the bore 38. Thus, the bore 64 is adapted to receive a driver spindle housing portion 66 of the actuator assembly 12 so that the apparatus 10 can be attached to and supported by the power actuator assembly 12.

As shown in FIG. 4, an elongated slot 68 is formed in the upper side 60 of the plate 54. The slot 68 extends from one edge portion 70 thereof and intersects the bore 64. The slot 68 supportingly receives one end of the hand-held body portion 16 of the actuator assembly 12 so that the driver spindle housing portion 66 can be secured within the bore 64 and the driver spindle 42 extends therethrough substantially as shown. A plurality of spatially disposed screw receiving bores 72 extend through the plate 54, and each of the screw receiving bores 72 is adapted to receive a screw 74 for securing the plate 54 to the impeller blade housing 56 as will hereinafter be described.

The impeller blade housing 56 of the housing assembly 20 is provided with a substantially planar upper side 80 having an axially disposed bore 82 extending therethrough, a side wall portion 84 forming a medial portion thereof, and a lower end portion 86. Thus, the impeller blade housing 56 constitutes an upper portion of the blower cavity 36.

The upper side 80 of the impeller blade housing 56 is positionable adjacent, and in an abutting relationship with the lower side 62 of the upper plate member 54. A plurality of threaded bores 88 are spatially disposed in the upper side 80 of the impeller blade housing 56 so as to be alignable with the screw receiving bores 72 of the upper plate member 54 such that the impeller housing portion 56 can be secured to the upper plate member 54 with the screw members 74.

As more clearly shown in FIGS. 2 and 5, the side wall 84 surrounding the upper portion of the blower cavity 36 contains the outlet port 40 so that dust and particulate matter passing upwardly through the blower cavity 36 exits the outlet port 40 as heretofore described. Further, the lower end portion 86 of the impeller blade housing 56 is provided with threads 90 for threadably engaging threads 92 formed within an upper end portion 94 of the brush housing 58.

Figure 3:
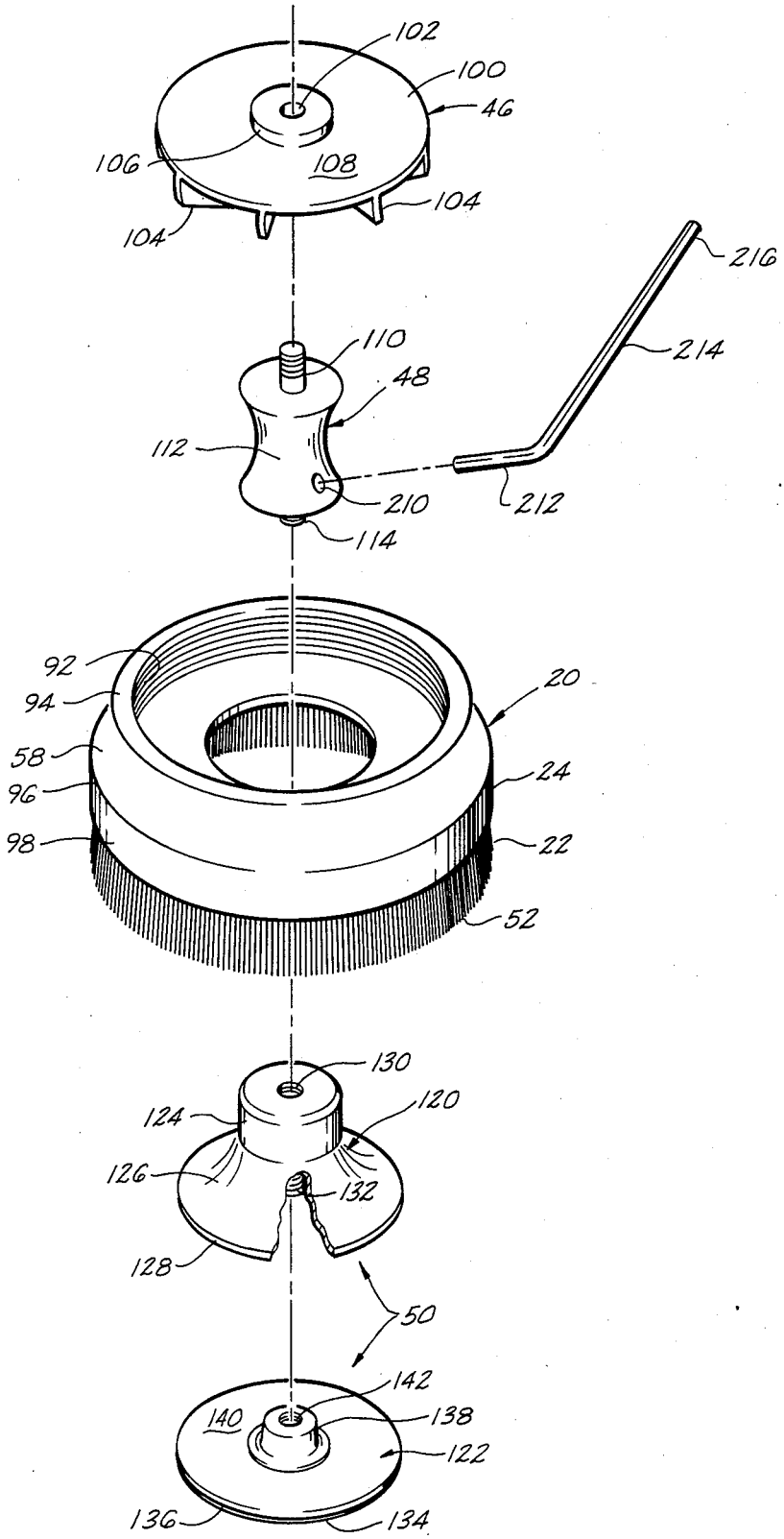
FIG. 3 is an exploded, partially cutaway view of components of the sanding and dust collecting apparatus of FIG. 1 for effecting the sanding and lifting action of dust and particulate matter removed by sanding action.

As shown in FIG. 3, the brush housing 58 is characterized as having the upper end portion 94, a medial portion 96 and a lower end portion 98. The medial portion 96 defines a lower end portion of the blower cavity 36, and the lower end portion 98 supports the brush 22. As previously stated, the brush 22 forms a dust containment curtain for the apparatus 10, and thus the brush 22 is a stationary brush. That is, as dust and particulate matter are thrown outwardly by the rotational movement of the sanding disc assembly 50, the brush 22, which does not rotate, contains the dust and particulate matter within the confines of the brush 22 and the brush housing 58 so that the dust and particulate matter can be directed upwardly through the blower cavity 36 by the impeller blade assembly 46.

Referring to FIGS. 2, 3 and 5, the impeller blade assembly 46, which is rotatably supported in the blower cavity 36 by the driver spindle 42, comprises a disc member 100 having a centrally disposed bore 102 extending therethrough, and a plurality of angularly disposed vane members 104 supported by the disc member 100. The impeller blade assembly 46 is positioned within the upper portion of the blower cavity 36 such that the angularly disposed vane members 104 are disposed substantially adjacent and aligned with the outlet port 40. Thus, upon actuation of the driver spindle 42 dust and particulate matter are directed upwardly through the blower cavity 36 by the rotation of the disc member 100 and the vane members 104 for exhausting from the blower cavity 36 through the outlet port 40.

In order to position the impeller blade assembly 46 in the upper portion of the blower cavity 36 so that the vane members 104 are substantially aligned with the outlet port 40, a spacer element 106 extends from an upper side 108 of the disc member 100 so as to be oppositely disposed relative to the vane members 104. The bore 102 extends through the disc member 100 and the spacer member 106 substantially as shown.

The spindle member 48 is characterized as having a threaded first end portion 110, a concave body portion 112 and a threaded opposed second end portion 114. The threaded first end 110 is positionable through the bore 102 of the disc member 100 and the spacer member 106 for threadingly engaging a distal end portion 116 of the driver spindle 42 via a threaded aperture 118 (FIG. 2). The connection of the threaded first end 110 of the spindle member 48 to the driver spindle 42 stabilizes and supports the impeller blade assembly 46 in the upper portion of the blower cavity 36 so that the impeller blade assembly 46 is rotated in response to the rotational movement of the driver spindle 42 and the spindle member 48. Further, the concave body portion 112 of the spindle member 48 provides a route for air, dust and particulate matter to travel upwardly through the blower cavity 36 into contact with the vane members 104 of the impeller blade assembly 46 so that the air, dust and particulate matter can be exhausted from the blower cavity 36 into the substantially dust impervious bag collector 28 via the outlet port 40 and the collector member 26.

The spindle member 48 extends downwardly through the impeller blade housing 56 and the brush housing 58 so that the threaded second end 114 of the spindle member 48 is connectable to the sanding disc assembly 50. Thus, the spindle member 48 functions as an extender for the impeller blade assembly 46 and the sanding disc assembly 50, while at the same time providing a route for air, dust and particulate matter to travel upwardly through the blower cavity 36 in response to the rotational movement of the angularly disposed vanes 104 of the impeller blade assembly 46.

The sanding disc assembly 50, as shown in FIG. 3, comprises a body member 120 and a sanding disc member 122. The body member 120 is provided with a substantially cylindrical shape upper end portion 124, a flared medial portion 126, and a lower end portion 128. The upper end portion 124 is provided with a threaded aperture 130 for threadably receiving the threaded second end 114 of the spindle member 48. The flared medial portion 126 of the body member 120 assists in the vortiginous movement of air, dust and particulate matter upwardly through the blower cavity 36 upon rotational movement imparted to the body member 120 in response to the rotation of the driver spindle 42. The lower end portion 128 of body member 120 is desirably provided a concave configuration, and a threaded post member 132 is supported by the lower end portion 128 substantially as shown.

The sanding disc member 122, a substantially circular shape member, is provided with a sanding or grinding element 134 on a lower side 136, and a post member 138 supported by an upper side 140 thereof. The post member 138 is provided with a threaded aperture 142 for threadably receiving the threaded post member 132 of the body member 120 so that the sanding disc member 122 can be secured thereto.

Figure 4A:
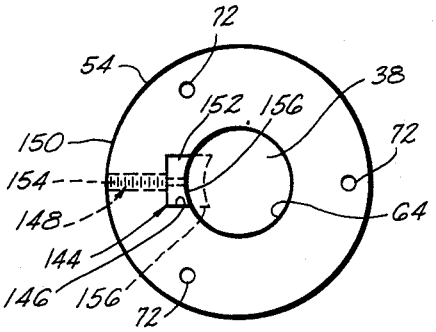
FIG. 4A is a bottom plan view of the an upper plate of FIG. 4 viewed substantially along line 4A—4A.

To secure the housing assembly 20 of the apparatus 10 to the actuator assembly 12, the apparatus 10 further comprises an actuator connector assembly 144, shown in FIG. 4A. The connector assembly 144 is supported by the plate member 54 and selectively engages the driver spindle housing 66 of the actuator assembly 12 for securing the driver spindle housing 66 within the bore 64 of the plate member 54. The plate member 54 is provided with a recessed portion 146 formed therein so as to communicate with the bore 64. A threaded bore 148 (shown by phantom lines) is disposed within the plate member 54 so as to extend between the recessed portion 146 and edge 150. Thus, the threaded bore 148 is disposed substantially normal to the bore 64.

The actuator connector assembly 144 comprises a tightening tab 152 and a threaded bolt 154 (shown by phantom lines) having an allen head outer end. The tab 152, provided with an arcuate shaped distal end 156, is positioned within the recessed portion 156 and is selectively movable between a retracted position (shown by solid lines) and an extended position (shown by phantom lines). In the retracted position, the tab 152 is disposed within the recessed portion 146 and its arcuate end shaped distal end 156 forms a continuation of the bore 64. On the other hand, when the tab 152 is moved via the threaded bolt 154 to the extended position, the distal end 156 selectively engages the driver spindle housing 66 disposed within the bore 64 of the plate member 54 so that the actuator assembly 12 and housing assembly 20 are securely connected.

To stabilize the driver spindle 42 for attachment thereto of the impeller blade assembly 46, the spindle member 48 and the sanding disc assembly 50, the apparatus 10 further comprises a thumb engageable wrench assembly 160 supported by the impeller blade housing 56 as shown in FIG. 4. The wrench assembly 160 is selectively movable between a normal non-engaging position and an engaging position. In its engaging position (which is only implemented when the actuator assembly 12 is in its off mode), the wrench assembly 160 selectively engages the driver spindle 42 and locks the driver spindle 42 in a stationary position. Upon locking the driver spindle 42 by engagement with the wrench assembly 160, the impeller blade assembly 46, the spindle member 48 and the sanding disc assembly 50 can readily be connected to or disconnected from the driver spindle 42.

The wrench assembly 160 comprises an elongated body member 162, a pin element 164 and a spring 166 for biasing the body member 162 is the non-engaging position. In order to secure the wrench assembly 160 to the impeller blade housing 56, the upper side 80 of the impeller blade housing 56 is provided with a first elongated slot 168 extending from an edge 170 of the upper side 80 so as to terminate at a position opposite the bore 82. A second elongated slot 172 is formed in the upper side 80 of the impeller blade housing 56 so as to be disposed substantially parallel to the first slot 168. A medial portion of the second slot 172 is in open communication with the first slot 168. Further, the second slot 172 is provided with a length substantially less than the first slot 168. Thus, the first and second slots 166 cooperate to receive and support the body member 162, the pin element 164 and the spring 166 such that the body member 162 of the the thumb engagement wrench assembly 160 can be selectively moved into a locking engagement with the driver spindle 42, or biased by the spring 166 in an unsuppressed, non-engaging position relative to the drive spindle 42. That is, the body member 162 is slidably supported within the first slot 168, and the pin element 164 is supported by the body member 162 so as to extend into the second slot 172. The spring 166 is disposed within the inward most end portion of the second slot 172 so as to engage the pin element 164 and bias the body member 162 away from the bore 82 and into a non-engaging position with the driver spindle 42.

The body member 162 of the wrench assembly 160 is characterized as having a first end portion 176, and an opposed second portion 178. The second end portion 178 includes a pair of spatially disposed legs 180, 182 which are slidinqly supported in matinq grooves along the inner walls of the first slot 168 in the impeller blade housing 56, the spaced apart legs 180 and 182 defining a spindle engaging slot 184 therebetween. The spindle engaging slot 184 is adapted to receive and engage opposed flat surface portions (not shown) of the driver spindle 42 for securing the driver spindle 42 in a stationary position when the elongated body member 170 is pressed inwardly and the legs 180, 182 extend into the bore 82.

As previously stated, air dust and particulate matter passing upwardly through the blower cavity 36 are exhausted therefrom via the outlet port 40 and passed through the collector member 26 for deposit and collection in the bag collector 28. As more clearly shown in FIGS. 2 and 4, the collector member 26 is characterized as having the one end portion 44, an opposed second end portion 190, and an internal bore 191 extensive therethrough. The first end portion 44 is provided with an arcuate configuration having a slot 192 formed therein. The first end portion 44 conforms to the external surface of the impeller blade housing 56, and the slot 192 substantially corresponds in size and configuration to the outlet port 40.

A plurality of apertures 194 are provided in the first end portion 44 of the collector member 44 and are alignable with threaded apertures 196 (one shown in FIG. 2). Screws 198 secure the collector member 26 to the impeller blade housing 56 to provide a substantially dust-tight connection therebetween, while at the same time providing open communication between the outlet port 40 and the collector member 26 via the slot 192. Air, dust and particulate matter directed upwardly through the blower cavity 36 of the housing assembly 20 are thus exhausted through the outlet port 40, through the collector member 26 (via the slot 192 and the bore 191), and into the bag collector 28.

In order to provide complete removal of the dust and particulate matter from the bore of the collector member 26, an elongated opening 200 is formed along a lower side 202 of the collector member 26 so as to extend from the second end 190 a selected distance along the collector member 26. The bag collector 28 is positionable over and connected to the collector member 26 for receiving dust and particulate matter therefrom and comprises a substantially dust impervious body portion 204 and a neck portion 206. The neck portion 206 is slidably positionable over the second end 190 of the collector member 26 such that the elongated opening 200 of the collector member 26 openly communicates with the interior portion of the body portion 204 of the bag collector 28. The neck portion 206 is connected to collector member 26 at a position between the first end 44 and the elongated opening 200 in the collector member 26 by the O-ring 30. To stabilize the O-ring 30 on the collector member 26, and thereby enhance the interconnection of the bag collector 28 to the collector member 26, an O-ring retaining groove 208 (FIG. 4) is provided in the collector member 26 a selected distance from the opening 200

Referring again to FIG. 3, to assist in the connection and disconnection of the sanding and dust lifting components of the apparatus 10 (that is, the impeller blade assembly 46, the spindle member 48 and the sanding disc assembly 50 to the driver spindle 42 of the actuator assembly 12) the concave body portion 112 of the spindle member 48 is provided with a wrench receiving aperture 210 extending therethrough. The aperture 210 is positioned in the body portion 112 such that the central axis of the aperture 210 is substantially normal to the elongated axis of the spindle member 48, and such that in an assembled position the vane members 104 of the impeller blade assembly 46 do not block access to the aperture 210. The aperture 210 is adapted to receive one end 212 of a tightening wrench 214, and upon positioning the wrench end 212 into the aperture 210, the spindle member 48 can be stabilized to assist in the attachment or removal of the body member 120 and the sanding disc member 122 to the spindle member 48. Similarly, upon positioning the end 212 of the wrench 214 into the aperture 210, and depressing the thumb engageable wrench assembly 160 so as to engage and lock the driver spindle 42 in a stationary position, torque can be applied to the wrench 214 to assist in either the connection or disconnection of the spindle member 48 to the driver spindle 42.

A second end 216 of the tightening wrench 214 is adapted to engage the distal end portion of the threaded bolt 154 of the actuator connector assembly 144 for selectively moving the tab 152 between the retracted position and the extended locking position. The wrench 214, in combination with the thumb engageable wrench assembly 160, can be used to connect or disconnect the spindle member 48 and the driver spindle; the wrench assembly 214, in combination with the aperture 210 in the body portion 112 of the spindle member 48, can be employed to stabilized the spindle member 48 for connecting or disassembling the sanding disc assembly 50 and the spindle member 48; and the wrench 214 can be employed to selectively advance or retract the tab 152 of the actuator connector assembly 144 for connecting or disconnecting the housing assembly 20 and the driver spindle housing portion 66 of the actuator assembly 12.

Figure 5A:
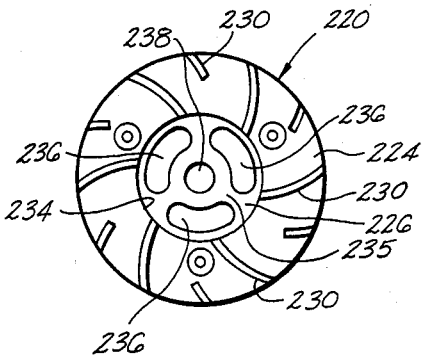
FIG. 5A is a bottom plan view of a vortex impeller assembly of the sanding and dust collecting apparatus of FIG. 5.

Referring now to FIGS. 5 and 5A, the sanding and dust collecting apparatus 10 further comprises a vortex impeller blade assembly 220. The vortex impeller blade assembly 220 is rotatably supported by the spindle member 48 so as to be disposed between the spindle member 48 and the sanding disc assembly 50. Thus, upon rotation of the spindle member 48 the vortex impeller blade assembly 220 is likewise rotated. The rotation of the vortex impeller blade assembly 220 creates a vortex-like suction within a lower portion of the blower cavity 36 and directs the airborne particulate materials generated by the sanding disc assembly 50 upwardly through the blower cavity 36 and into contact with the impeller blade assembly 46 so that the material is discharged from the blower cavity 36 via the outlet port 40 of the housing assembly 20.

The vortex impeller blade assembly 220 comprises a disc member 224, a cylindrical shaped upper portion 226 supported by an upper side 228 of the disc member 224, and a plurality of angularly disposed vane member 230 supported by a lower side 232 of the disc member 224. The disc member 224 and the upper portion 226 cooperate to form a centrally disposed bore 234.

The upper portion 226 of the vortex impeller blade assembly 220 is provided with a cap member 235 having also provided a plurality of arcuate shaped slots 236 formed about a centrally disposed aperture 238. The flared medial portion 126 of the body member 120 is positionable within the bore 234 such that the threaded second end portion 116 of the spindle member 48 extends through the aperture 238 for connection of the spindle member 48 to the sanding disc assembly 50.

The configuration of the flared medial portion 126 combine with the vane members 230 and the arcuate shaped slots 236 to provide an air-flow path through the brush housing portion 58. Thus, upon activation of the actuator assembly 12 to its on mode by suppression of the trigger mechanism 18, the vortex impeller blade assembly 220 is rotated by the driver spindle 42. The rotation of the vortex impeller blade assembly 220 creates a flow of air upwardly through the blower cavity 36. That is, the combination of the rotation of the vortex impeller blade assembly 220 and the impeller blade assembly 46 creates a negative pressure upward from the vane member 230 of the vortex impeller blade assembly 220 (i.e. a vacuum-type air flow) so that the particulate matter passing therethrough is exhausted through the outlet port 40 of the housing assembly 20 by the vane members 104 of the impeller blade assembly 46.

In operation, residue generated by the sanding disc assembly 50 is thrown outwardly against the dust containment curtain (i.e. the brush 22) and is retained within the confines of the brush 22. The negative (vacuum) air pressure created by the rotation of the vane members 230 of the vortex impeller blade assembly 220 and the vane members 104 of the impeller blade assembly 46 picks the residue up, passes it upwardly through the slots 236 in the cap member 235 of the vortex impeller blade assembly 220, through the blower cavity 36 and into contact with the vane members 104 of the impeller blade assembly 46 for discharge through the outlet port 40 of the housing assembly 22 and into the bag collector 28. The vacuuming action of the apparatus 10 is thus achieved by the action of the sanding disc assembly 50, the brush 22, the blower cavity 36, and the rotation of the vortex impeller blade assembly 220 and the impeller blade assembly 46. The apparatus 10 is a self contained unit which does not require other attachments for the control of a substantial dust-free environment as dust and particulate matter are removed from a surface by the rotational action of the sanding disc assembly 50.

From the above, it is clear that the present invention is well adapted to carry out the objects and to attain the ends and advantages mentioned herein as well as those inherent in the invention. While a preferred embodiment of the invention has been described for the purposes of this disclosure, numerous changes can be made which will readily suggest themselves to those skilled in the art and which are encompassed within the spirit and scope of the invention disclosed herein and as defined in the appended claims.

I claim:

1. A sanding and dust collecting apparatus for use in combination with a powered actuator asembly having a rotatable driver spindle, the apparatus comprising:

a housing assembly attachable to and supportable by the actuator assembly, the housing assembly having an upper end portion and a lower end portion, the housing assembly defining a blower cavity therein, the housing assembly further including an axially disposed bore extending therethrough communicating with the blower cavity for receiving the driver spindle of the actuator assembly and an outlet port disposed in a sidewall of the blower cavity, the upper end portion of the housing being provided with a first elongated slot and a substantially parallel second elongated slot openly communicating with the first slot, the first elongated slot extending inwardly to communicate with the axially disposed bore of the housing assembly, the second elongated slot disposed within the upper end portion of the housing assembly and having a length less than the first elongated slot;

impeller blade means rotatingly supported in the blower cavity by the drive spindle for creating a vortex-like suction within the housing assmebly when rotated by the driver spindle and for exhausting through the outlet port thereof;

a spindle a member having a first end portion and an opposed second end portion, the first end portion connected to the driver spindle for securing the impeller blade means adjacent the driver spindle, the spindle member extending from the driver spindle such that the second end portion thereof is disposed substantially adjacent the lower end portion of the housing assembly;

sanding disc means for sanding a selected surface, the sanding disc means supportable by the second end of the spindle member;

brush means supported by the lower end portion of the housing assembly for forming a flexible dust containment curtain about the sanding disc means when in contact with the surface being sanded;

thumb engageable wrench means supported by the housing assembly for selectively engaging the driver spindle and for locking the driver spindle in a stationary position when the actuator assembly is in an off mode so that the impeller blade means, the spindle member and the sanding disc means can be installed and removed, the thumb engageable wrench means comprising;

an elongated body member slidably supported in the first elongated slot, the elongated body member characterized as having a first end portion and an opposed second end portion, the second end portion having a pair of spatially disposed legs defining a spindle engaging slot therein adapted to receive and secure the driver spindle in a stationary position;

a pin element supported by the body member and substantially normally disposed to the body member at a position substantially intermediate the first and second end portions thereof so as to extend into the second slot; and biasing means disposed within the second slot for engaging the pin element and for biasing the elongated body member away from the axial bore to a non-engaging position with the driver spindle;

a collector member having a first end portion and an opposed second end portion with an internal bore extensive therethrough, the first end portion of the collector member connected to the housing assembly such that the bore thereof communicates with the outlet port of the blower cavity of the housing asembly; and bag collector means supportable by the collector member for receiving and collecting particulate material removed from the surface by the sanding disc means when the driver spindle is rotated.

2. The sanding and dust collecting apparatus of claim 1 further comprising:

connector means for connecting the housing assembly to the actuator member such that the driver spindle is positioned within the axially disposed bore.

3. The sanding and dust collecting apparatus of claim 2 wherein the first end portion of the spindle member is threaded, the end of the driver spindle has a threaded aperture, and the impeller blade means comprises:

a disc member having a centrally disposed bore, the first end portion of the spindle member extendable through the centrally disposed bore and threadingly engageable with the aperture of the driver spindle such that the disc member is connected to the driver spindle by the first end portion of the spindle member; and a plurality of angularly disposed vane members supported by the disc member for directing airborne particulate material passing upwardly through the cavity of the housing assembly into the collector means via the outlet port.

4. The sanding and dust collecting apparatus of claim 3 wherein the collector member is further characterized as having an upper side and a lower side, the collector member having an elongated opening formed along the lower side so as to extend from the second end a selected distance along the collector member, and wherein the apparatus further comprises:

means for connecting the bag collector means to the collector member such that the portion of the collector member having the elongated opening in the lower side thereof is disposed within the bag collector means.

5. The sanding and dust collecting apparatus of claim 4 wherein the bag collector means comprises:

a substantially dust impervious bag having a body portion and a neck portion, the neck portion defining a passageway communicating with the body portion, the neck portion slidably positionable over on the collector member.

6. The sanding and dust collecting apparatus of claim 5 wherein a medial portion of the collector member is provided with a groove extending thereabout, the groove being positioned substantially intermediate the first end portion and the elongated slot formed in the lower side thereof, and wherein the means for connecting the bag collector means to the collector member comprises an O-ring member supportable within the groove, and wherein the neck portion of the substantially dust impervious bag is supportable by the collector member such that at least a portion of the neck portion is disposed over the groove.

7. The sanding and dust collecting apparatus of claim 6 wherein the housing assembly comprises:

an upper plate member having a substantially planar upper side and a substantially parallel planar lower side, an axially disposed bore extending therethrough and a elongated slot formed in the upper side so as to extend from one edge portion of the first plate member to the axially disposed bore, the elongated slot being angularly disposed relative to the outlet port;

an impeller blade housing having a substantially planar upper side having an axially disposed bore extending therethrough, a medial portion, and a lower end portion, the medial portion and lower end portion defining an upper portion of the cavity of the housing, the planar upper side of the impeller blade housing containing the first and second elongated slots for receiving the elongated body portion, the pin element and the biasing means of the thumb engageable wrench means, the planar upper side of the impeller blade housing being abutted against the planar lower side of the plate member such that the first elongated slot formed in the impeller blade housing is angularly disposed relative to the elongated slot in the plate member, the outlet port of the housing being disposed in the medial portion of the impeller blade housing;

first connector means for connecting the plate member to the impeller blade housing;

a brush housing having an upper end portion, a medial portion and a lower end portion, the medial portion and lower end portion of the brush housing cooperating with the medial and lower end portion of the impeller blade housing to define the cavity of the housing assembly, the lower end portion of the brush housing supporting the stationary brush means; and second connector means for connecting the upper end portion of the brush housing to the lower end portion of the impeller blade housing.

8. The sanding and dust collecting apparatus of claim 7 wherein the upper end portion of the brush housing is provided with a substantially centrally disposed bore extending therethrough for receiving the spindle member and for establishing communication between the brush housing and the impeller blade housing.

9. The sanding and dust collecting apparatus of claim 8 wherein the upper end portion of the brush housing is provided with a recessed portion surrounding the centrally disposed bore formed therein, and wherein the second connector means comprises:

male threads formed on the lower end portion of the impeller blade housing and female threads formed along the recessed portion of the brush housing for matingly engaging the male threads of the lower end portion of the impeller blade housing and connecting the brush housing and the impeller blade housing.

10. The sanding and dust collecting apparatus of claim 9 wherein the sanding disc means comprises:

a body member having an upper end portion, a vortically-shaped medial portion and a lower end portion, the upper end portion having a threaded apparatus formed therein for threadably receiving the threaded second end portion of the spindle member;

a sanding disc; and means for connecting the sanding disc to the lower end portion to the body member.

11. The sanding and dust collecting apparatus of claim 10 wherein the body member is provided with a threaded aperture in the lower end portion thereof and wherein the means for connecting the sanding disc to the body member comprising a threaded post member supported by the sanding disc for threadingly engaging the threaded aperture in the lower end portion of the body member.

12. The sanding and dust collecting apparatus claim 11 wherein the spindle member is provided with a concave body portion have a bore extending therethrough, said bore being substantially normally disposed to the elongated axis of the spindle member, and wherein the apparatus further comprises wrench means for engaging the spindle member via the bore thereof for applying force to the spindle member so that the impeller blade means, the spindle member, the body member and the sanding disc can be securely connected, and such that upon engagement of the thumb engageable wrench means with the driver spindle of the actuator means the threaded first end portion of the spindle member can be connected to the driver spindle of the actuator means.

13. The sanding and dust collecting apparatus of claim 1 further comprising:

vortex blade means for lifting and directing particulate materials removed by the sanding disc means upwardly through the blower cavity of the housing assembly in the direction of the impeller blade means, the vortex blade means supported on the sanding disc means.

14. The sanding and dust collecting apparatus of claim 13 wherein the second end portion of the spindle member is threaded and the vortex blade means comprises:

a disc member having a cylindrically shaped upper portion, the disc member and the upper portion having centrally disposed bore extending therethrough for receiving an upper portion of the sanding disc means such that the second end portion of the spindle member is connectable to sanding disc means, the disc member having a plurality of slots formed in the upper portion thereof about the bore; and a plurality of angularly disposed vane members supported by the disc member for directing particulate material upwardly through the bore and the slots in the disc member and into the blower cavity of the housing assembly for engagement with vane members of the impeller blade means for delivery of the particulate matter into the bag collector means.

15. The sanding and dust collecting apparatus of claim 14 wherein the bag collector means comprises:

a substantially dust impervious bag having a body portion and a neck portion, the neck portion defining a passageway communicating with the body portion, the neck portion slidably positionable over on the collector member.

16. The sanding and dust collecting apparatus of claim 15 wherein a medial portion of the collector member is provided with a groove extending thereabout, the groove being position substantially intermediate the first end portion and the elongated slot formed in the lower side thereof, and wherein the means for connecting the bag collector means to the collector member comprises an O-ring member supportable within the groove, and wherein the neck portion of the air passage bag is supportable over the collector member and secured thereto by sealing of the O-ring member in the groove.

17. The sanding and dust collecting apparatus of claim 16 wherein the housing assembly comprises:

an upper plate member having a substantially planar upper side and a substantially parallel planar lower side, an axially disposed bore extending therethrough and a elongated slot formed in the upper side so as to extend from one edge portion to the axially disposed bore, the elongated slot being angularly disposed relative to the outlet port;

an impeller blade housing forming the blade cavity having a substantially planar upper side having an axially disposed bore extending therethrough, a medial portion, and a lower end portion, the medial portion and lower end portion defining an upper portion of the cavity of the housing, the planar upper side of the impeller blade housing containing the first and second elongated slots for receiving the elongated body portion, the pin element and the biasing means of the thumb engageable wrench means, the planar upper side of the impeller blade housing being abutted against the planar lower side of the plate member such that the first elongated slot form in the impeller blade housing is angularly disposed relative to the elongated slot in the plate member, the outlet port of the housing being disposed in the medial portion of the impeller blade housing;

first connector means for connecting the plate member to the impeller blade housing;

a brush housing having an upper end portion, a medial portion and a lower end portion, the medial portion and lower end portion of the brush housing cooperating with the medial and lower end portion of the impeller blade housing to define the cavity of the housing assembly, the lower end portion of the brush housing supporting the brush means; and second connector means for connecting the upper end portion of the brush housing to the lower end portion of the impeller blade housing.

18. The sanding and dust collecting apparatus of claim 17 wherein the upper end portion of the brush housing is provided with a substantially centrally disposed bore extending therethrough for receiving the spindle member and for establishing communication between the brush housing and the impeller blade housing.

19. The sanding and dust collecting apparatus of claim 18 wherein the upper end portion of the brush housing is provided with a recessed portion surrounding the centrally disposed bore formed therein, and wherein the second connector means comprises:

male threads formed on the lower end portion of the impeller blade housing and female threads formed along the recessed portion of the brush housing for matingly engaging the male threads of the lower end portion of the impeller blade housing and connecting the brush housing and the impeller blade housing.

20. The sanding and dust collecting apparatus of claim 19 wherein the sanding disc means comprises:

a body member having a substantially cylindrically shaped upper end portion, a vortically-shaped medial portion and a lower end portion, the upper end portion having a threaded apparatus formed therein for threadably receiving the threaded second end portion of the spindle member;

a sanding disc: and means for connecting the sanding disc to the lower end portion of the body member.

21. The sanding and dust collecting apparatus of claim 20 wherein the body member is provided with a threaded apparatus in the lower end portion thereof and wherein the means for connecting the sanding disc to the body member comprising a threaded post member supported by the sanding disc for threadingly engaging the threaded aperture in the lower end portion of the body member.

22. The sanding and dust collecting apparatus of claim 21 wherein the spindle member is provided with a concave body portion have a bore extending therethrough, said bore being substantially normally disposed to the elongated axis of the spindle member, and wherein the apparatus further comprises wrench means for engaging the spindle member via the bore thereof for applying force to the spindle member so that the impeller blade means, the spindle member, the body member and the sanding disc can be securely connected, and such that upon engagement of the thumb engageable wrench means with the driver spindle of the actuator means the threaded first end portion of the spindle member can be connected to the driver spindle of the actuator means.

23. A combination sanding and dust collecting apparatus comprising:

a housing assembly having an upper end portion, a continuous side wall, a lower end portion, and an internally disposed blower cavity extending from the lower end portion and terminating a distance from the upper end portion, the upper end portion having an axially disposed bore extending therethrough so as to openly communicate with the blower cavity, the housing assembly further provided with an outlet port in the sidewall thereof at a position below the axially disposed bore so as to openly communicate with the blower cavity;

actuator means having an on mode and an off mode for providing powerd rotation of a driver spindle thereof when in the on mode, the driver spindle extendable through the axially disposed bore in the housing assembly;

connector means for connecting the housing assembly to the actuator member such that the drive spindle is rotationally supported within the axially disposed bore;

impeller blade means rotatably supported by the actuator means in the blower cavity of the housing assembly for creating a vortex-like suction within the blower cavity when the actuator means is in an on mole, the impeller blade means being disposed substantially adjacent the outlet port;

thumb engageable wrench means supported by the housing assembly for selectively engaging the driver spindle and securing same in a stationary position when the actuator assembly is in its off mode;

a spindle member having a first end portion, a concave body portion and an opposed second end portion, the concave body portion having a bore extending therethrough which is substantially normally disposed to the elongated axis of the spindle member, the first end portion of the spindle member connectable to the drive spindle such that the impeller blade means is disposed between the drive spindle and the spindle member, the impeller blade means and the spindle member being rotated by the driver spindle when the actuator means is in its on mode, the second end portion of the spindle member being disposed in close proxdimity to the lower end portion of the housing assembly;

sanding disc means connectable to the second end portion of the spindle member for rotation thereby for sandingly engaging a surface when the actuator assembly is in its on mode;

wrench means for engaging the spindle member via the bore thereof for applying force to the spindle member so that the impeller blade means, the spindle member, and the sanding disc means can be connected to each other, and such that upon engagement of the thumb engageable wrench means with the driver spindle the first end portion of the spindle member can be connected to the driver spindle;

brush means supported by the lower end portion of the housing assembly for forming a stationary flexible dust containment curtain about the sanding disc means;

a collector member supported by the housing assembly and having a first end portion, an opposed second end portion, and an internal bore extension therethrough, the first end portion connected to the housing assembly such that communication is established between the internal bore of the collector member and the outlet port of the housing assembly; and bag means connected to the collector member via the second end portion for receiving and collecting particulate material exiting the blower cavity via the outlet port and the collector member.

24. The sanding and dust collecting apparatus of claim 23 further comprising:

vortex blade means for lifting and directing particulate materials removed by the sanding disc means upwardly through the blower cavity of the housing assembly in the direction of the impeller blade means, the vortex blade means being supported by the sanding disc means so as to be interposed between the spindle member and the sanding disc means.

25. The sanding and dust collecting apparatus of claim 23 wherein the upper end portion of the housing assembly is provided with a first elongated slot and a substantially parallel second elongated slot openly communicating with the first slot, the first elongated slot extending inwardly to communicate with the axially disposed bore of the housing assembly, the second elongated slot disposed within the upper end portion of the housing assembly and having a length less than the first elongated slot, and wherein the thumb engageable wrench means comprises:

an elongated body member slidably supported in the first elongated slot, the elongated body member characterized as having a first end portion and an opposed second end portion, the second end portion having a pair of spatially disposed legs defining a spindle engaging slot therein adapted to receive and secure the driver spindle in a stationary position;

a pin element supported by the body member and substantially normally disposed to the body member at a position substantially intermediate the first and second end portions thereof so as to extend into the second slot; and biasing means disposed within the second slot for engaging the pin element and for biasing the elongated body member away from the axial bore to a non-engaging position with the driver spindle.

26. The sanding and dust collecting apparatus of claim 24 wherein the sanding disc means comprises:

a body member having an upper end portion, a vortically-shaped medial portion and a lower end portion, the upper end portion having a threaded apparatus formed therein for threadably receiving the threaded second end portion of the spindle member;

a sanding disc; and means for connecting the sanding disc to the lower end portion to the body member.

27. The sanding and dust collecting apparatus of claim 26 wherein the second end portion of the spindle member is threaded and the vortex blade means comprises:

a disc member having a cylindrically shaped upper portion disposable with a lower side portion of the blower cavity, the disc member and the upper portion having a centrally disposed bore extending therethrough for receiving the upper end portion and vortically-shaped medial portion of the body member, the second end portion of the spindle member extendable through an upper portion of the bore for conenction to the upper end portion of the body member, the cylindrically shaped upper portion of the disc member having a plurality of arcuate shaped slots formed about the bore; and a plurality of angularly disposed vane members supported by the disc member for directing particulate material upwardly through the cylindrically shaped upper portion for passage through the arcuate shaped elongated slots and into the blower cavity.

28. The sanding and dust collecting apparatus of claim 23 wherein the collector member is further characterized as having an upper side and a lower side, the collector member having an elongated opening formed along the lower side so as to extend from the second end a selected distance along the collector member, and wherein the apparatus further comprises:

means for connecting the bag means to the collector member such that the portion of the collector member having the elongated opening in the lower side thereof is disposed within the bag means.

29. The sanding and dust collecting apparatus of claim 28, wherein the bag means comprises:

a substantially dust impervious body portion and a neck portion, the neck portion defining a passageway communicating with the body portion, the neck portion slidably positionable over on the collector member.

30. The sanding and dust collecting apparatus of claim 29 wherein a medial portion of the collector member is provided with a groove extending thereabout, the groove being positioned substantially intermediate the first end portion of the handle member and the elongated slot formed in the lower side thereof, and wherein the means for connecting the neck portion of the bag means to the connector member comprises an O-ring member supportable within the groove.

31. The sanding and dust collecting apparatus of claim 25 wherein the housing assembly comprises:

an upper plate member having a substantially planar upper side, a substantially parallel planar lower side, an axially disposed bore extending therethrough and a slot formed in the upper side so as to to extend from one edge portion of the upper plate member and terminate at a position opposite the axially disposed bore, the slot being substantially aligned with the outlet port;

an impeller blade housing forming an upper portion of the blower cavity, the impeller blade housing having a substantially planar upper side and an axially disposed bore extending therethrough, a medial portion, and a lower end portion, the planar upper side of the impeller blade housing containing the first and second elongated slots for receiving the elongated body portion, the pin element and the biasing means of the thumb engageable wrench means, the planar upper side of the impeller blade housing abuttable against the planar lower side of the upper plate member such that the first elongated slot formed in the impelller blade housing is angularly disposed relative to the slot in the planar upper side of the upper plate member, the outlet port of the housing being disposed in the medial portion of the impeller blade housing;

first connector means for connecting the upper plate member to the impeller blade housing;

a brush housing having an upper end portion, and a lower end portion, the upper end portion of the brush housing disposed adjacent the lower end portion of the impeller blade housing so as to define the blower cavity, the lower end portion of the brush housing supporting the brush means; and second connector means for connecting the upper end portion of the brush housing to the lower end portion of the impeller blade housing.

32. The sanding and dust collecting apparatus of claim 31 wherein the upper end portion of the brush housing is provided with a recessed portion surrounding a centrally disposed bore formed therein, and wherein the second connector means comprises:

male threads formed on the lower end portion of the impeller blade housing and female threads formed along the recessed portion of the brush housing for matingly engaging the male threads of the lower end portion of the impeller blade housing.

33. The sanding and dust collecting apparatus of claim 32 wherein the body member is provided with a threaded aperture in the lower end portion thereof and wherein the means for connecting the sanding disc to the body member comprising a threaded post member supported by the sanding disc for threadingly engaging the threaded aperture in the lower end portion of the body member.

34. The sanding and dust collecting apparatus of claim 23 further comprising:

vortex blade means for lifting and directing particulate materials removed by the sanding disc means upwardly through the blower cavity of the housing assembly in the direction of the impeller blade means, the vortex blade means being supported by the sanding disc means so as to be interposed between the spindle member and the sanding disc means.

35. The sanding and dust collecting apparatus of claim 34 wherein the second end portion of the spindle member is threaded and the vortex blade means comprises:

a disc member having a cylindrically shaped upper portion, the disc member having an opening therethrough communicating with the upper portion, and the upper portion having centrally disposed bore extending therethrough for receiving the second end portion of the spindle member such that the spindle member is connectable to sanding disc means, the cylindrically shaped upper portion having a plurality of slots formed therein about the bore; and a plurality of angularly disposed vane members supported by the disc member for directing particulate material upwardly through the opening therein, through the cylindrical shaped upper portion and the slots therein, and into the blower cavity of the housing assembly for engagement with the impeller blade means for delivery of the particulate matter into the bag collector means.

36. The sanding and dust collecting apparatus of claim 23 wherein the bag means comprises:

a substantially dust impervious body portion and a neck portion, the neck portion defining a passageway communicating with the body portion, the neck portion slidably positionable over on the collector member.

37. The sanding and dust collecting apparatus of claim 36 wherein a medial portion of the collector member is provided with a groove extending thereabout, the groove being position substantially intermediate the first end portion and the elongated slot formed in the lower side thereof, and wherein the means for connecting the neck portion to the connector member comprises an O-ring member.

38. The sanding and dust collecting apparatus of claim 38 wherein the upper end portion of the brush housing is provided with a substantially centrally disposed bore extending therethrough for receiving the spindle member and for establishing communication between the brush housing and the impeller blade housing.

39. The sanding and dust collecting apparatus of claim 38 wherein the upper end portion of the brush housing is provided with a recessed portion surrounding the centrally disposed bore formed therein, and wherein the second connector means comprises:

male threads formed on the lower end portion of the impeller blade housing and female threads formed along the recessed portion of the brush housing for matingly engaging the male threads of the lower end portion of the impeller blade housing and connecting the brush housing and the impeller blade housing.

* * * * *

UNITED STATES PATENT AND TRADEMARK OFFICE

CERTIFICATE OF CORRECTION

PATENT NO. : 4,765,099

DATED : August 23, 1988

INVENTOR(S) : John G. Tanner

It is certified that error appears in the above-identified patent and that said Letters Patent is hereby corrected as shown below:

In column 7, line 67, the word "engagement" should read --engageable--. In column 8, line 16, the word "slidingly" should read --slidingly--. In column 8, line 16, the word "matinq" should read --mating--. In column 9, lines 41 and 42, "wrench assembly 214" should read --wrench 214--. In column 10, line 27, "vane member 230" should read --vane members 230--. In claim 1, column 11, line 2, the words "actuator asembly" should read --actuator assembly--. In claim 1, column 11, line 24, the word "assmebly" should read --assembly--. In claim 1, column 12, line 7, the word "asembly" should read --assembly--. In claim 23, column 16, line 50, the words "on mole" should --on mode--. In claim 23, column 17, line 1, the word "proxdimity" should read --proximity--. In claim 38, column 20, line 41, "claim 38" should read --claim 31--.

Signed and Sealed this

Twenty-fourth Day of October, 1989

*Attest:*

DONALD J. QUIGG

*Attesting Officer*

*Commissioner of Patents and Trademarks*